US007397447B2

(12) United States Patent
Matsumoto

(10) Patent No.: US 7,397,447 B2
(45) Date of Patent: Jul. 8, 2008

(54) CIRCUIT IN LIGHT EMITTING DISPLAY

(75) Inventor: Shoichiro Matsumoto, Ogaki (JP)

(73) Assignee: Sanyo Electric Co., Ltd. (JP)

( * ) Notice: Subject to any disclaimer, the term of this patent is extended or adjusted under 35 U.S.C. 154(b) by 761 days.

(21) Appl. No.: 10/814,438

(22) Filed: Mar. 30, 2004

(65) Prior Publication Data

US 2004/0233141 A1 Nov. 25, 2004

(30) Foreign Application Priority Data

Mar. 31, 2003 (JP) ..... 2003-094084
Mar. 17, 2004 (JP) ..... 2004-076973

(51) Int. Cl.
*G09G 3/10* (2006.01)
*G09G 3/30* (2006.01)

(52) U.S. Cl. ..... 345/76; 315/169.3

(58) Field of Classification Search ..... 345/55–100, 345/204–214; 315/169.3
See application file for complete search history.

(56) References Cited

U.S. PATENT DOCUMENTS 5,952,789 A 9/1999 Stewart et al.
6,229,506 B1 * 5/2001 Dawson et al. ..... 345/82
6,501,466 B1 12/2002 Yamagishi et al.
6,930,680 B2 * 8/2005 Miyazawa ..... 345/76
7,138,967 B2 11/2006 Kimura
7,142,199 B2 * 11/2006 Jang et al. ..... 345/76
7,154,454 B2 * 12/2006 Okabe et al. ..... 345/76
7,227,517 B2 * 6/2007 Imamura ..... 345/76
2003/0038760 A1 2/2003 Kim et al.
2003/0090446 A1 * 5/2003 Tagawa et al. ..... 345/76
2003/0184510 A1 10/2003 Chen
2004/0017162 A1 1/2004 Sato et al.

(Continued)

FOREIGN PATENT DOCUMENTS

EP 1102234 A 5/2001

(Continued)

OTHER PUBLICATIONS

Office Action for Application No. 10/813,800 mailed Feb. 27, 2007.

(Continued)

*Primary Examiner*—David L. Lewis
(74) *Attorney, Agent, or Firm*—Cantor Colburn LLP

(57) ABSTRACT

A light emitting display having an emissive element which emits light in response to a supplied current, comprises a drive current generating element for generating a drive current for allowing light to be emitted from the emissive element, a data line onto which a voltage signal and a current signal corresponding to data regarding an amount of light emission from the emissive element are sequentially supplied, and a voltage storage element connected to the data line and for sequentially storing a charge voltage based on the voltage signal and the current signal corresponding to data regarding the amount of light emission. The drive current generated by the drive current generating element based on a charge voltage corresponding to the current signal stored in the voltage storage element is supplied to the emissive element so that generation of precise drive current corresponding to data regarding the amount of light emission is enabled and the time required for writing data into the voltage storage element is shortened.

3 Claims, 6 Drawing Sheets

U.S. PATENT DOCUMENTS

| | | | |
|---|---|---|---|
| 2004/0207617 | A1 | 10/2004 | Matsumoto |
| 2004/0233142 | A1 | 11/2004 | Matsumoto et al. |
| 2005/0024352 | A1 | 2/2005 | Sano |

FOREIGN PATENT DOCUMENTS

| | | | |
|---|---|---|---|
| EP | 1296310 | A | 3/2003 |
| JP | 2001147659 | | 5/2001 |
| WO | WO 02071379 | A | 9/2002 |

OTHER PUBLICATIONS

Office Action for Application No. 10/833,183 mailed Mar. 28, 2007.

European Search Report dated May 4, 2006 for related EP application No. 04251932.2-2205.

"Current-Writing Active-Matrix Circuit for Organic Light-Emitting Diode Display Using a-Si:H Thin-Film-Transistors", Hattori et al., IEICE Trans. Electron., vol. E83-C, No. 5, May 2000, pp. 779-782.

Hattori et al., Current-Writing Active Matrix Circuit for Organic Light-Emitting Diode Display Using a-Si:H Thin-Film-Transistors, IEICE Trans. Electron, vol. E38-C, No. 5, May 2000, pp. 779-782.

First Examination Report for the corresponding Chinese Patent Application No. 2004/10030933.1 and its excerpt English translation; Mailed Date: Jul. 6, 2007; Applicant: Sanyo Electric Co., Ltd.

* cited by examiner

CIRCUIT IN LIGHT EMITTING DISPLAY

BACKGROUND OF THE INVENTION

1. Field of the Invention

The present invention relates to an electroluminescence (hereinafter simply referred to as "EL") display circuit for controlling light emission from an EL element based on both a data voltage and data current generated based on data for driving the EL element.

2. Description of the Prior Art

Because EL display devices in which a self-emitting EL element is used as an emissive element in each pixel have advantages such as that the device is thin, self-emitting, and consumes less power, EL display devices have attracted much attention as alternatives to display devices such as liquid crystal display (LCD) and cathode ray tube (CRT) display devices.

In particular, a high resolution display can be achieved by an active matrix EL display device in which a switching element such as a thin film transistor (hereinafter simply referred to as "TFT") for individually controlling an EL element is provided in each pixel and the EL element in each pixel is controlled.

In an active matrix EL display device, a plurality of gate lines extend along a row direction over a substrate, a plurality of data lines and power supply lines extend along a column direction over the substrate, and each pixel has an organic EL element, a selection TFT, a driver TFT, and a storage capacitor. In this structure, a gate line is selected so that the selection TFT is switched on, a data voltage on a data line is charged into the storage capacitor, and the driver TFT is switched on by this data voltage to allow electric power to flow from a power supply line through the organic EL element.

Japanese Patent Laid-Open Publication No. 2001-147659 (hereinafter simply referred to as "the '659 Publication") discloses a circuit in which two p-channel TFTs are added in each pixel as controller transistors and a data current corresponding to display data is applied to a data line.

FIG. 1 shows a pixel circuit disclosed in the '659 Publicatio. As shown, one terminal of an n-channel TFT3 (selection TFT) having its gate connected to a scan line scanA is connected to a data line DL onto which a current Iw is to be applied. The other terminal of the selection TFT3 is connected to one terminal of a p-channel TFT1 and one terminal of a p-channel TFT4 (driver TFT). The other terminal of the TFT1 is connected to a power supply line Vdd and a gate of the TFT1 is connected to a gate of a p-channel TFT2 for driving an organic EL element ("OLED"). The other terminal of the TFT4 is connected to the gates of the TFT1 and TFT2 and a gate of the TFT4 is connected to a scan line scanB.

In this structure, the scan line scanA is set to an H level to switch the TFT3 on, and the scan line scanB is set to an L level to switch on the TFT4. A current Iw corresponding to data is applied to the data line DL, which causes the gate and source of the TFT1 to be connected (short-circuited) due to the switching on of the TFT4, the current Iw is converted to a voltage, and this voltage is set to voltages of the gates of the TFT1 and TFT2. After the TFT3 and TFT4 are switched off, the gate voltage of the TFT2 is maintained by a storage capacitor C, thus allowing a current corresponding to the current Iw to flow through the TFT2 and through the OLED so that light is emitted from the OLED based on the amount of supplied current. Then, when the scanB is set to an L level, the TFT1 is switched on, the gate voltage of the TFT1 is increased, the storage capacitor C is discharged, data is erased, and the TFT1 and TFT2 are switched off.

In this circuit, when a current flows through the TFT1, the current is converted to a voltage and the gate voltage of the TFT1 and TFT2 is determined. According to the determined gate voltage, the amount of current flowing through the TFT2 is determined. Thus, the amount of current flowing through the TFT2 can be set corresponding to a data current Iw.

However, in the circuit of the '659 Publicatio, the data current Iw is allowed to flow through the TFT1 to set the gate voltage of the TFT2. Therefore, it cannot be assured that the current flowing through the TFT2 corresponds to the data current. Thus, this system is commonly called an "indirect specification system".

Another reference, R. Hattori et al., IECE TRANS. ELECTRON., Vol. E83-C, No. 5, pp. 779-782, May (2000) (hereinafter simply referred to as the "Hattori reference") discloses a circuit having a structure in which a data current is set to a storage capacitor while the data current is supplied onto the data line and flows through a driver TFT. Because a gate voltage of the driver TFT is directly determined by the data current, this system is commonly referred to as "direct specification system".

FIG. 2 shows a structure of a circuit disclosed in the Hattori reference. A source of a p-channel driver TFT5 is connected to a power supply Vdd, an anode of an organic EL element OLED is connected to a drain of the driver TFT5 through a p-channel TFT6, and a cathode of the OLED is connected to a ground.

A gate of the driver TFT5 is connected to a data line DL through a p-channel TFT7 and is connected to a power supply line Vdd through a storage capacitor C. In addition, a connection point between the driver TFT5 and the TFT6 is connected to the data line DL through a TFT8.

A read line Read which extends along the row direction is connected to a gate of the TFT6 and a write line Write which also extends along the row direction is connected to gates of the TFT7 and TFT8.

In this circuit, while a data current corresponding to display data is supplied onto the data line DL, the write line Write is set to an L level to switch on the TFT7 and TFT8 and the read line Read is set to an H level to switch off the TFT6. With this configuration, a data current Idata flowing on the data line DL flows from the power supply Vdd through the driver TFT5 and TFT8. Because TFT7 is switched on, the gate voltage of the TFT5 is set to a voltage of the TFT5 when Idata flows through the TFT5 and this voltage is stored in the storage capacitor C.

Then, the write line Write is set to an H level and the read line Read is set to an L level to switch off the TFT7 and TFT8 and switch on the TFT6. Because the gate voltage of the TFT5 is maintained at the voltage stored in the storage capacitor C, a current identical to the current Idata continues to flow through the TFT5.

In this manner, a current Ioled corresponding to the data current Idata can flow through the organic EL element OLED and light can be emitted. In particular, in this circuit, a data voltage is written into the storage capacitor C by actually supplying the data current Idata corresponding to the display data through the driver TFT5. With this structure, it is possible to precisely set the drive current Ioled of the organic EL element OLED.

As described, with the direct specification system, it is possible to more precisely control a drive current of an organic EL element.

In such a circuit, however, a current value corresponding to minimum video data (minimum current value) is directly written into the storage capacitor. When the number of gradations is small, it is possible to set the minimum current value to a relatively large value. However, when it is desired that the number of gradations be large in order to realize a high resolution display, the minimum current value is significantly small. In order to reliably set a charge voltage of the storage capacitor corresponding to a data current having a small current value, the time required for writing data for each pixel becomes significantly large. Therefore, in a direct specification system, there had been a problem in that a display with a large number of pixels and a large number of gradations was difficult.

In the indirect specification system, on the other hand, it is possible to set the write current corresponding to the minimum video data to a relatively large value by changing the sizes (size ratio) of the TFT1 and TFT2, which allows for a short writing time. However, as described above, the indirect specification system is inferior to the direct specification system in the precision of written data.

SUMMARY OF THE INVENTION

The present invention advantageously provides a structure which allows for precise writing of data and reduction of time required for the writing operation.

According to one aspect of the present invention, there is provided a light emitting display having an emissive element which emits light in response to a supplied current, the light emitting display comprising a drive current generating element for generating a drive current for allowing light to be emitted from the emissive element; a data line onto which a voltage signal and a current signal corresponding to data regarding an amount of light emission from the emissive element are sequentially supplied; and a voltage storage element connected to the data line and for sequentially storing a charge voltage based on the voltage signal and the current signal corresponding to data regarding the amount of light emission; wherein the emissive element emits light based on a drive current generated by the drive current generating element based on the charge voltage stored in the voltage storage element and corresponding to the current signal.

According to another aspect of the present invention, it is preferable that, in the light emitting display, the voltage storage element is charged based on the voltage signal supplied onto the data line, and the drive current generating element generates the drive current based on the current signal which is supplied following the voltage signal and the voltage storage element is re-charged when the drive current is generated in the drive current generating element.

According to another aspect of the present invention, it is preferable that, in the light emitting display, a switch circuit is provided for sequentially switching and supplying the voltage signal and the current signal corresponding to data regarding the amount of light emission onto the data line.

As described, a voltage storage element stores a voltage which is set on a data line, and then a voltage corresponding to a current which is set on the data line.

By setting a voltage on the data line, it is possible to quickly set the charge voltage of the voltage storage element to a predetermined voltage and to precisely set the charge voltage of the voltage storage element by a current which is set on the data line afterwards.

According to another aspect of the present invention, it is preferable that, in the light emitting display, the drive current generating element is a driver transistor for generating a drive current corresponding to a voltage supplied on its gate; the voltage storage element is a storage capacitor element connected to the gate of the driver transistor for storing the gate voltage; a drive current control transistor is provided between the driver transistor and the emissive element for controlling whether or not to supply the drive current from the driver transistor to the emissive element; a first write control transistor is connected between the data line and a connection portion between the driver transistor and the drive current control transistor; and a second write control transistor is connected between the data line and the gate of the driver transistor.

According to another aspect of the present invention, it is preferable that, in the light emitting display, each of a plurality of pixels arranged in a matrix form has such an emissive element; each of a plurality of data lines is provided for pixels in each column of the matrix; and pixels of adjacent rows of the matrix are respectively connected to different data lines among the plurality of the data lines.

According to another aspect of the present invention, it is preferable that, in the light emitting display, each of the plurality of pixels further comprises the driver transistor, the storage capacitor element, the first and second write control transistors, and the drive current control transistor; a selection line for voltage writing and a selection line for current writing are provided for each row of the matrix; a gate of the second write control transistor is connected to the selection line for voltage writing; and a gate of the first write control transistor is connected to the selection line for current writing.

According to another aspect of the present invention, there is provided a method for driving a light emitting display, the method comprising switching on the second write control transistor during a period in which the voltage signal is supplied onto the data line to write the voltage signal into the storage capacitor element having one terminal connected to the gate of the driver transistor; switching on the first write control transistor and the second write control transistor during a period in which the current signal is supplied onto the data line to supply the drive current having a current value equal to that of the current signal to the driver transistor through the first write control transistor, and, at the same time, to write the gate voltage of the driver transistor when the drive current is supplied into the storage capacitor element; and switching off the first and second write control transistors and switching on the drive current control transistor to supply, through the drive current control transistor to the emissive element, the drive current having a current value equal to that of the current signal written into the storage capacitor element.

According to another aspect of the present invention, there is provided an electroluminescence display circuit comprising a driver transistor for generating a drive current corresponding to a voltage supplied on its gate; an electroluminescence element which is driven by a drive current from the driver transistor; a drive current control transistor connected between the driver transistor and the electroluminescence element for controlling whether or not to supply the drive current from the driver transistor to the electroluminescence element; a first write control transistor having a first region connected to a connection portion between the driver transistor and the drive current control transistor and a second region connected to the data line; a second write control transistor having a first region connected to the data line and a second region connected to the gate of the driver transistor; and a storage capacitor connected to the gate of the driver transistor for storing the gate voltage, wherein a data voltage signal and a data current signal corresponding to data regarding an amount of light emission are sequentially supplied onto the data line; the second write control transistor is switched on during when the drive current control transistor and the first write control transistor are switched off and a data voltage signal is supplied onto the data line, to write the data voltage signal into the storage capacitor; the first write control transistor is switched on during when a data current signal is supplied onto the data line so that the data current signal is supplied to the data line through the driver transistor and the first write control transistor, and, at the same time, a voltage corresponding to the data current signal is written into the storage capacitor via the second write control transistor; and, then, the first and second write control transistors are switched off and the drive current control transistor is switched on so that a drive current corresponding to the voltage written into the storage capacitor is generated in the driver transistor and the drive current is supplied to the electroluminescence element via the drive current control transistor and light is emitted.

According to another aspect of the present invention, there is provided an electroluminescence display having an electroluminescence element in each of a plurality of pixels arranged in a matrix form for achieving a display by controlling light emission from each pixel, wherein each of a plurality of data lines is provided corresponding to each column of the matrix and a different data line among the plurality of data lines is connected to corresponding pixels for each row of the matrix; and display data is sequentially supplied from the plurality of data lines for pixels of each column of the matrix.

In this manner, by providing a plurality of data lines, it is possible to simultaneously write data into pixels on a plurality of rows, allowing for reduction of time for writing in the overall device.

According to another aspect of the present invention, it is preferable that, in the electroluminescence display, both a data voltage signal and a data current signal regarding display data can be switched and supplied onto each of the plurality of data lines; and the data voltage signal and data current signal regarding display data are sequentially supplied to each pixel so that the display of each pixel is controlled.

According to another aspect of the present invention, it is preferable that, in the electroluminescence display, two control lines are provided for each row of the matrix; each of the pixels has a plurality of transistors controlled by the two control lines; and the writing of the data voltage signal and the writing of the data current signal into each of the pixels are controlled by the two control lines.

As described, according to the present invention, a voltage storage element stores a voltage which is set on a data line, and then stores a voltage corresponding to a current which is set on the data line. By setting a voltage on the data line, it is possible to set the charge voltage of the voltage storage element to a predetermined voltage in an early stage, and to precisely set the charge voltage of the voltage storage circuit with a current which is set on the data line later on.

DESCRIPTION OF PREFERRED EMBODIMENT

Figure 1:
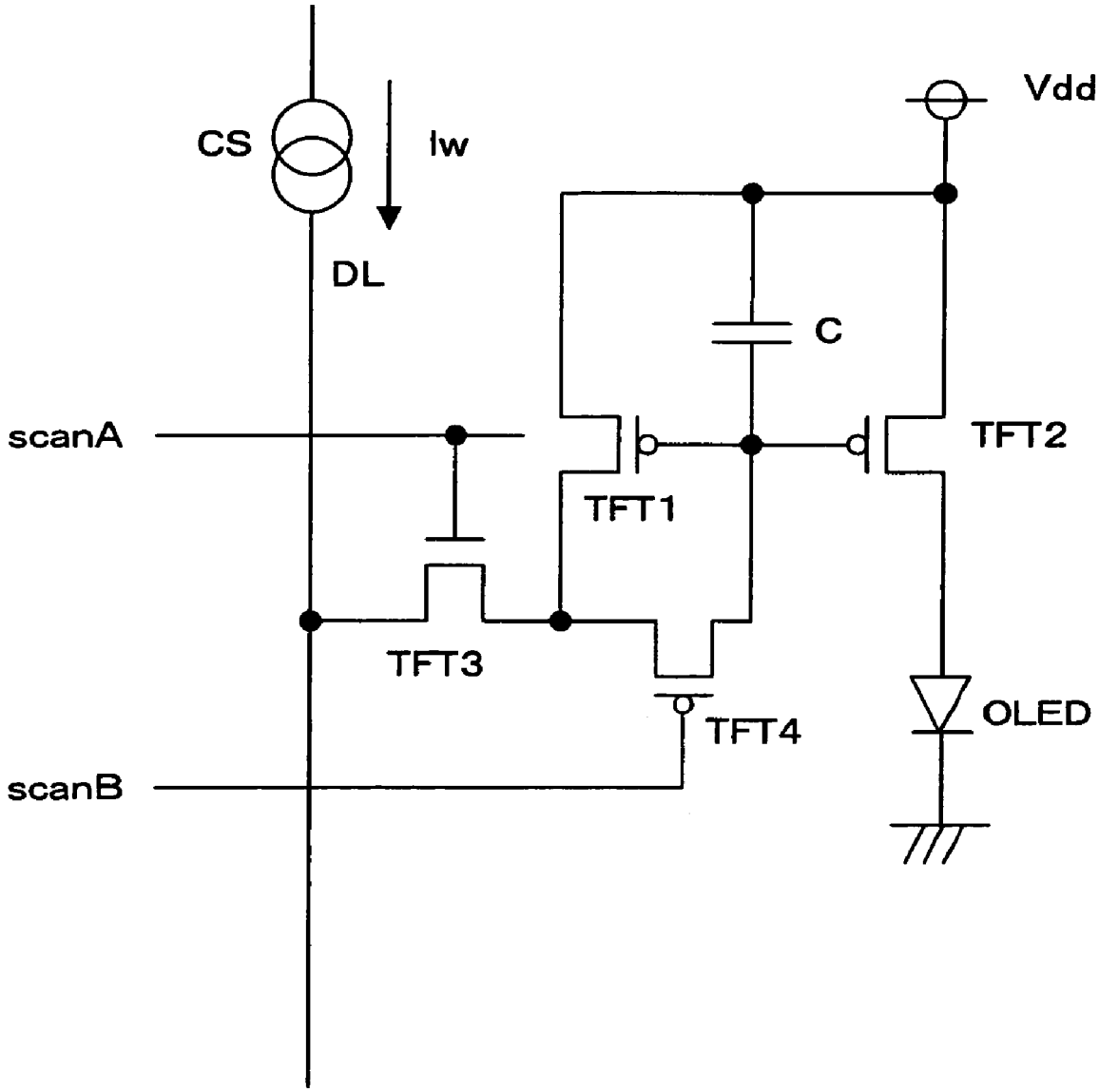
Fig. 1 PRIOR ART
FIG. 1 is a diagram showing a structure of a pixel circuit of an indirect specification system according to prior art.
Figure 2:
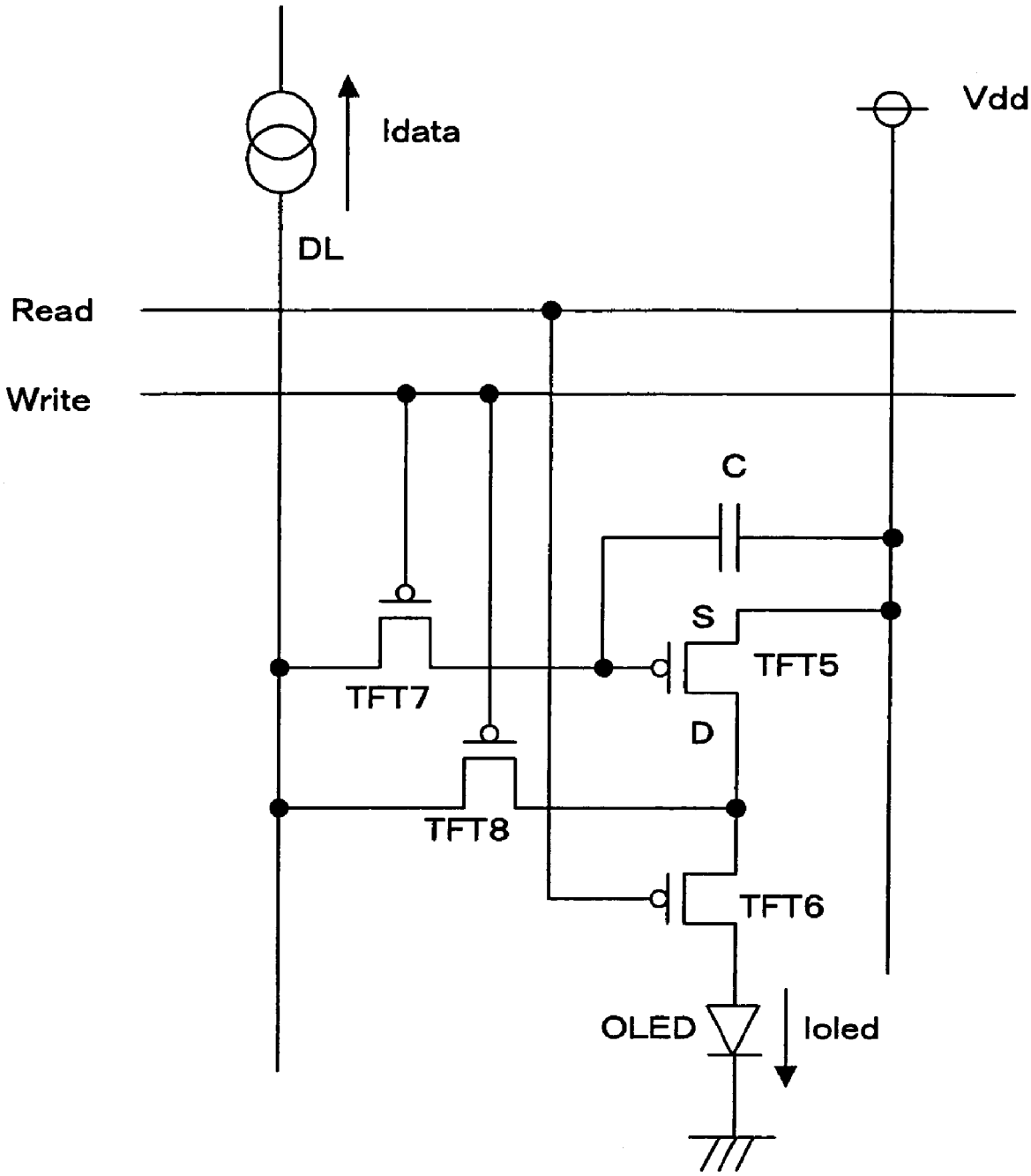
Fig. 2 PRIOR ART
FIG. 2 is a diagram showing a structure of a pixel circuit of a direct specification system according to prior art.

A preferred embodiment of the present invention will now be described referring to the drawings.

Figure 3:
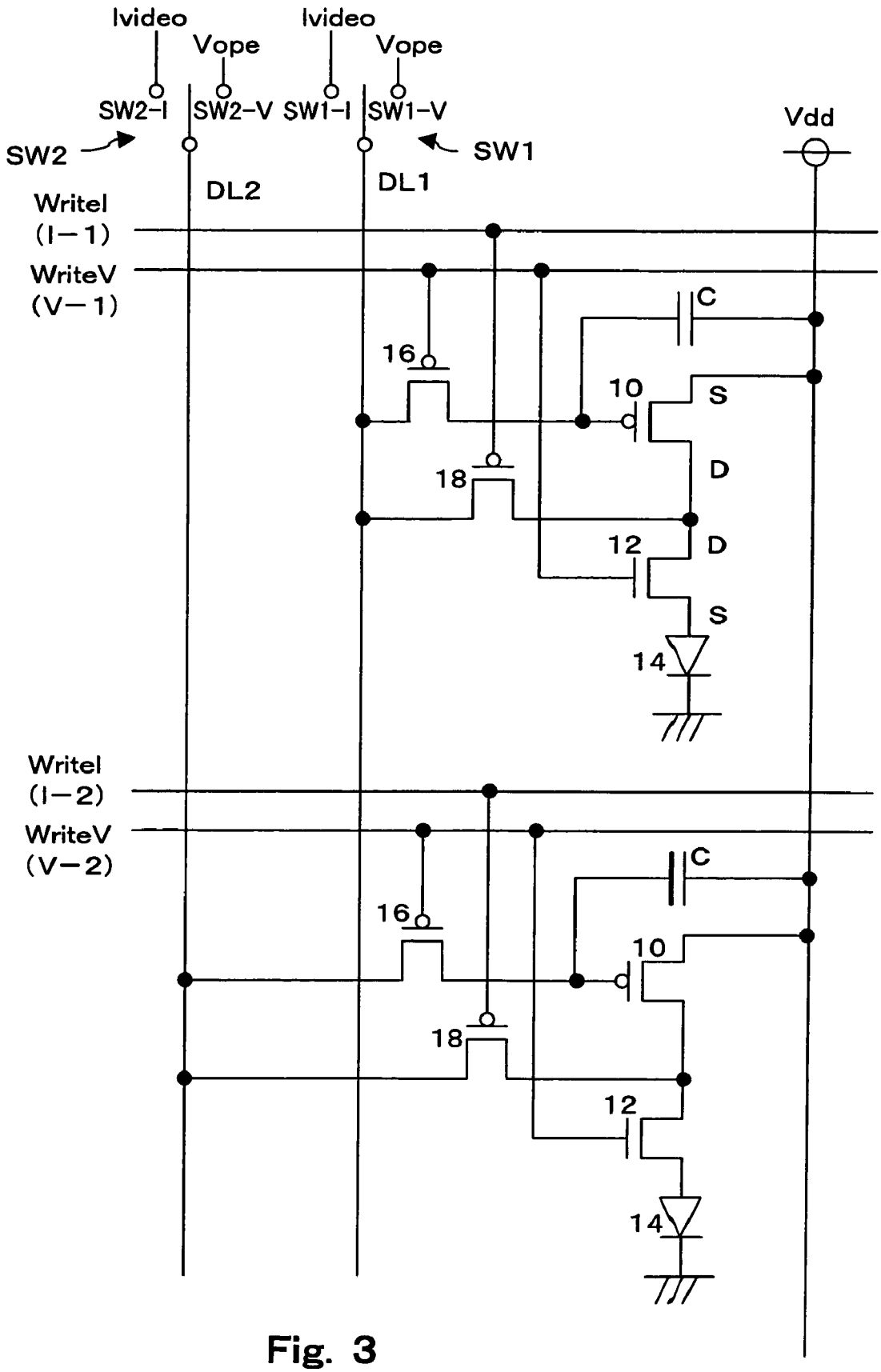
FIG. 3 is a diagram showing a structure of a pixel circuit of a light emitting display according to a preferred embodiment of the present invention.

FIG. 3 is a diagram showing a structure of the preferred embodiment. A source (source region) of a p-channel TFT 10 is connected to a power supply Vdd and a drain (drain region) of the p-channel TFT 10 is connected to an anode of an organic EL element 14 via an n-channel TFT 12. A cathode of the organic EL element 14 is connected to a ground.

A gate of the TFT 10 is connected to a data line DL (DL1 or DL2) through a p-channel TFT 16 and is also connected to a power supply line Vdd via a storage capacitor C. A connection point between the TFT 10 and the TFT 12 is connected to the data line DL via the TFT 18.

A write line WriteI which extends along the row direction is connected to a gate of the TFT 18 and a write line WriteV which also extends along the row direction is connected to gates of the TFTs 12 and 16.

In the present embodiment, as the data line DL, two data lines, that is, one of a first data line DL1 and a second data line DL2 is provided corresponding to each column. The TFTs 16 and TFTs 18 are respectively alternatively connected to the first data line DL and the second data line DL2 every other row.

The first and second data lines DL1 and DL2 are configured such that one of a current video signal Ivideo and a voltage operation signal Vope is selectively supplied on the data lines respectively via switches SW1 and SW2. The SW1 selects Ivideo when a signal SW1-I is at an H level and selects Vope when a signal SW1-V is at an H level. Similarly, the switch SW2 selects Ivideo when a signal SW2-I is at an H level and selects Vope when a signal SW2-V is at an H level.

Various control clocks used in this circuit will now be described referring to FIG. 4. Two clocks CKV1 and CKV2 complementarily repeat an H level and an L level every 1 H (1 horizontal period) in order to control signals to be supplied to a pixel circuit of every other row (horizontal line). In other words, when the clock CKV1 is at the H level, the clock CKV2 is at the L level, and so on. These states are repeated.

The write signals for the rows, WriteV-1, WriteV-2, WriteV-3, . . . becomes an L level for a period of 2H. However, the timing in which the write signal becomes an L level differs by 1H period from that of the adjacent row. More specifically, the WriteV-1 signal becomes an L level for 2 clock cycles from the point when the CKV1 becomes an H level, and then, the WriteV-2 and WriteV-3 signals sequentially become L level with a delay of 1H period each.

The write signals WriteI-1, WriteI-2, WriteI-3, etc., become an L level during the second half of the L level period for the corresponding write signals WriteV-1, WriteV-2, WriteV-3, etc.

A control signal SW1-V of the switch SW1 becomes H level in the first half of the L level period of the write signals WriteV-1, WriteV-3, WriteV-5, etc., so that the data line DL1 is connected to Vope and a control signal SW2-V of the switch SW2 becomes H level in the first half of the L level period of the write signals WriteV-2, WriteV-4, WriteV-6, etc., so that the data line DL2 is connected to Vope.

Similarly, a control signal SW1-I of the switch SW1 becomes H level when any of the write signals WriteI-1, WriteI-3, WriteI-5, etc. are at an L level, so that the data line DL1 is connected to Ivideo and a control signal SW2-I of the switch SW2 becomes H when any of the write signals WriteI-2, WriteI-4, WriteI-6, etc. is at an L level, so that the data line DL2 is connected to Ivideo.

Operations of each pixel circuit by the signals as described above will now be described referring to an operation in one exemplary pixel (an upper pixel in the drawing).

When the signal SW1-V becomes H level, the switch SW1 selects Vope. Because the signal WriteV-1 is L level and WriteI-1 is H level, the TFTs 12 and 18 are switched off and the TFT 16 is switched on, so that Vope is charged in to the storage capacitor C and the gate potential of the TFT 10 is set at this voltage.

Here, Vope is a voltage value based on brightness data of the pixel (brightness data separate for R, G, and B when the data is separate for R, G, and B). With supply of this voltage, the charging of the storage capacitor C is quickly completed.

Then, the signal SW1-V becomes L level and the signal SW1-I becomes H level, so that the switch SW1 now selects Ivideo. The signal WriteV-1 maintains its L level state, but because the signal WriteI-1 becomes L level, the TFT 18 is switched on and current Ivideo flows from the power supply Vdd through the source (source region) and drain (drain region) of the TFT 10 and through the source (source region) and drain (drain region) of the TFT 18. A gate voltage of the TFT 10 during when the current Ivideo flows through the TFT 10 is written into the storage capacitor C. As described above, the gate voltage of the TFT 10 is preliminarily set by Vope and thus, the amount of charge/discharge by Ivideo is small, which allows for quick completion of charge/discharge even with a small minimum brightness current in a multiple gradation display.

In this manner, the writing of brightness data is completed and the signals WriteV-1 and WriteI-1 become H level. With this configuration, the TFT 12 is switched on and current from the power supply Vdd flows through the organic EL element 14. As described, because the gate voltage of the TFT 10 is set at a voltage when Ivideo flows through the TFT 10 and this voltage is stored in the storage capacitor C, the current flowing through the organic EL element 14 is substantially identical to Ivideo.

As described, according to the present embodiment, a direct specification system is employed in which Ivideo is allowed to flow through the TFT 10 to set the gate potential of the TFT 10, and thus, precise control of the current can be achieved. In addition, because the gate voltage can be set in advance with Vope, it is possible to significantly reduce the time required for writing brightness data, which facilitates adaptations to a display with a large number of gradations.

Figure 5:
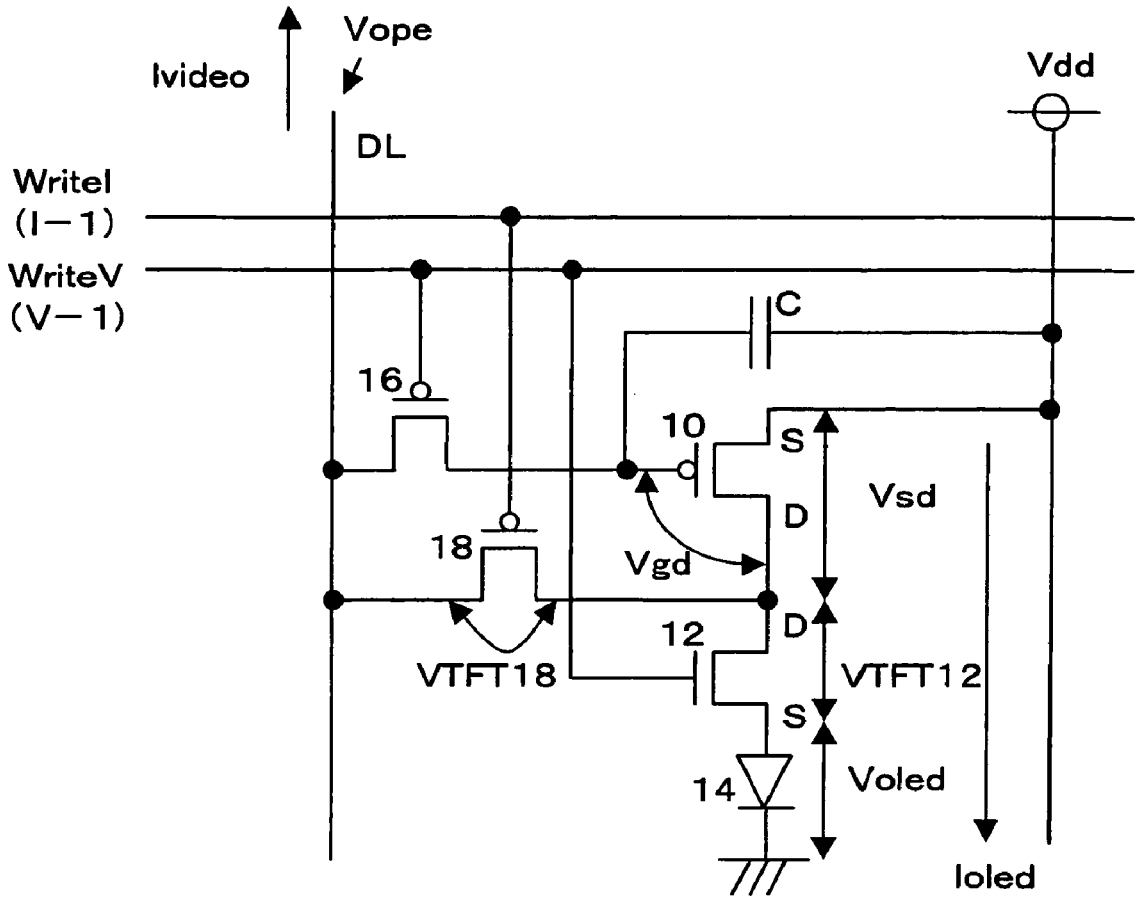
FIG. 5 is a diagram explaining Vope.

Next, the voltage Vope to be input will be described referring to FIG. 5. The voltage Vope is not a voltage which directly indicates video information, but rather voltage information for setting an operation point of the TFT 10 for allowing flow of a current signal Ioled which is brightness information to flow through the organic EL element. In other words, the current Ivideo corresponding to brightness information and which is to flow through the data line DL is approximately equal to the current Ioled flowing through the organic EL element 14 (Ivideo≈Ioled). When the TFTs 10 and 18 are switched on and Ivideo is supplied, the Vope has a value in which the on resistances of the TFTs 10 and 18 are subtracted from Vdd, that is, $Vope=Vdd-(Vsd+V_{TFT18})$. When, on the other hand, the current Ioled flows through the organic EL element 14, Vope has a value in which the on resistance $V_{TFT12}$ of the TFT 12 and the on resistance Voled of the organic EL element are added to the gate-drain voltage Vgd of the TFT10, that is, $Vope=Voled+V_{TFT12}+Vgd$.

Vope can be set in this manner. Because the characteristics of the organic EL element 14 and various TFTs are known in advance, it is possible to calculate Vope corresponding to a brightness signal. Therefore, when a pixel is to be designed, it is possible to calculate, in advance, a relationship curve for converting an input brightness signal into Vope through simulations, to provide a circuit which performs a conversion based on the relationship curve, and to supply the output of this circuit as Vope.

In addition, in the present embodiment, a data line DL2 is provided in parallel to the data line DL1. Pixels arranged along the vertical scan direction are alternatively connected to the data lines DL1 and DL2 every other row and writing operations of Vope and Ivideo are performed for pixels arranged along the column direction with a shift of 1H (horizontal scan period) of the clock CKV1. Therefore, the timings of the initiation of light emission from the organic EL elements 14 from the pixels along the vertical direction are each shifted by 1H. After data is written from the data line DL1 to pixels in the first row at 2H, the data line DL1 is used to write data to pixels on the third row in the next 2H period, and this process is repeated sequentially for pixels in odd rows. Similarly, after data is written from the data line DL2 into pixels in the second row, the data line DL2 is used to write data into pixels in the fourth row, and this process is repeated sequentially for pixels in even rows. Writing of data into pixels on the second row is 1H later than writing of data into the first row. Thus, data is sequentially written from the pixels of the first row and then into subsequent lower rows with a shift of 1H. Therefore, although data writing into pixels requires 2 clock cycles including 1H for writing Vope and 1H or wiring Ivideo, the time required for writing data into one column is similar to a configuration in which data is written in each line at 1H.

In the above description, only pixels of one column are described. In reality, however, a voltage (Vope) is sequentially written for all pixels of one row in a period of 1H, and then, current (Ivideo) is sequentially written into all pixels of one row at the next 1H period. When current is written to pixels of one row, voltage is written into the pixels of the next row in parallel.

In particular, it is preferable that a dot sequential method is employed for the writing of voltage in which Vope for all pixels of one row (one horizontal line) are sequentially output onto the data line DL1 or DL2 over a 1H period and that a line sequential method is employed for the writing of current in which Ivideo for all pixels of one row are applied onto the data line DL1 or DL2 at once over a 1H period. Alternatively, it is also possible to employ a block sequential method for the writing of current in which pixels on one line is divided in to a plurality of blocks in a horizontal direction and data of Ivideo within a block are applied to the data line DL1 or DL2 in parallel for each block. In such a case, the number N (number of divisions in the horizontal scan direction) of the blocks is determined by dividing the length of 1H period by current writing time. For example, when the current writing time is tw, N=1H/tw. In this manner, writing of current can be reliably completed.

Figure 6:
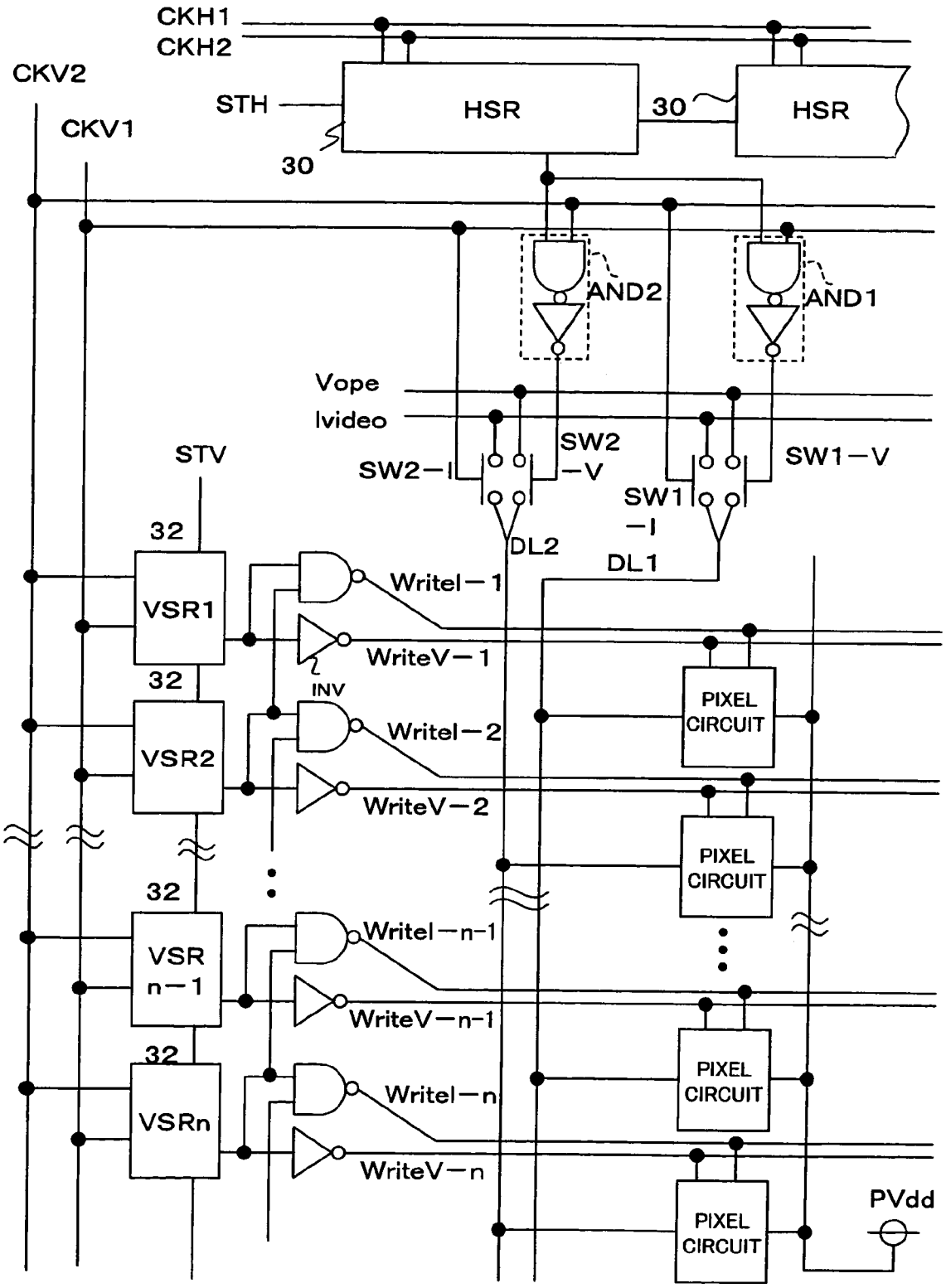
FIG. 6 is a diagram showing a structure of a peripheral circuit according to a preferred embodiment of the present invention.

FIG. 6 shows a structure of a peripheral circuit for supplying the above-described signals to each pixel circuit. A horizontal shift register 30 outputs signals to control timing of writing data onto each pixel in a horizontal line. In other words, for each pixel, with dot clocks CKH1 and CKH2 having a timing corresponding to video data (in this case, Vope), a pulse of H level (STH or horizontal start pulse) is transferred at every period of one dot clock and signals for sequentially selecting pixels in the horizontal scan direction are output.

An output of the horizontal shift register (HSR) 30 is input into AND gates AND1 and AND2 provided for each column. CKV1 is input into the AND gate AND1 and CKV2 is input into the AND gate AND2. When CKV1 is at H level, an activating clock (H clock) is output from the AND gate AND1, and, when CKV2 is at H level, an activating clock is output from the AND gate AND2.

An output of the AND gate AND1 forms a control signal of the switch SW1-V and an output of the AND gate AND2 forms a control signal of the switch SW2-V. The switch SW1-V connects Vope and data line DL1 and the switch SW2-V connects Vope and data line DL2. Therefore, during a 1H period in which CKV1 is at H level, the switch SW1-V is switched on and Vope which changes for each pixel is supplied onto the data line DL1. During a 1H period in which CKV1 is at L level and CKV2 is at H level, on the other hand, the switch SW2-V is switched on and Vope is supplied onto the data line DL2.

In a 1H period in which Vope is supplied onto the data line DL2, a switch SW1-I is switched on and Ivideo is supplied onto the data line DL1. Here, Ivideo is not supplied in a dot sequential manner, but rather is line sequential data or block sequential data. Therefore, a current based on video data which changes for each pixel must be supplied to each pixel on the corresponding column during the 1H period. For this purpose, current sources, the number of which corresponds to the number of pixels in the horizontal direction are provided and current is generated from the current source and output via the switches SW1-I, SW2-I, etc.

When a video signal supplied from an external circuit or the like is a voltage signal, it is possible to sample the video signal and generate a current based on the sampled value. In other words, it is possible to obtain a structure which functions as a current source of Ivideo in each column by charging a voltage signal into a desired storage capacitor, driving a transistor with a voltage charged in the storage capacitor, and generating a current.

In the vertical scan direction, vertical shift registers 32 (VSR1-VSRn) are provided into which CKV1 and CKV2 are input. The vertical shift registers 32 are configured such that the register in each row outputs a selection signal which becomes an H level for a period of 2H by sequentially transferring, for example, a vertical start pulse (STV) based on CKV1 and CKV2. The timings at which the selection signals become H level are shifted by a period of 1H for each horizontal scan line. Therefore, in a second half 1H period in which a selection signal of one line above is at H level, a selection signal of one row below is also at H level.

A selection signal of one row is output as a signal WriteV-1 which is inverted by an inverter INV, and, at the same time, is output as a signal WriteI-1 via a NAND gate NAND into which the selection signal of next row is input. Because two selection signals sequentially become H level, the signals WriteV-1, WriteV-2, WriteV-3, . . . and WriteI-1, WriteI-2, WriteI-3, . . . shown in FIG. 4 are respectively output to each row based on an output from one vertical shift register 32.

Figure 4:
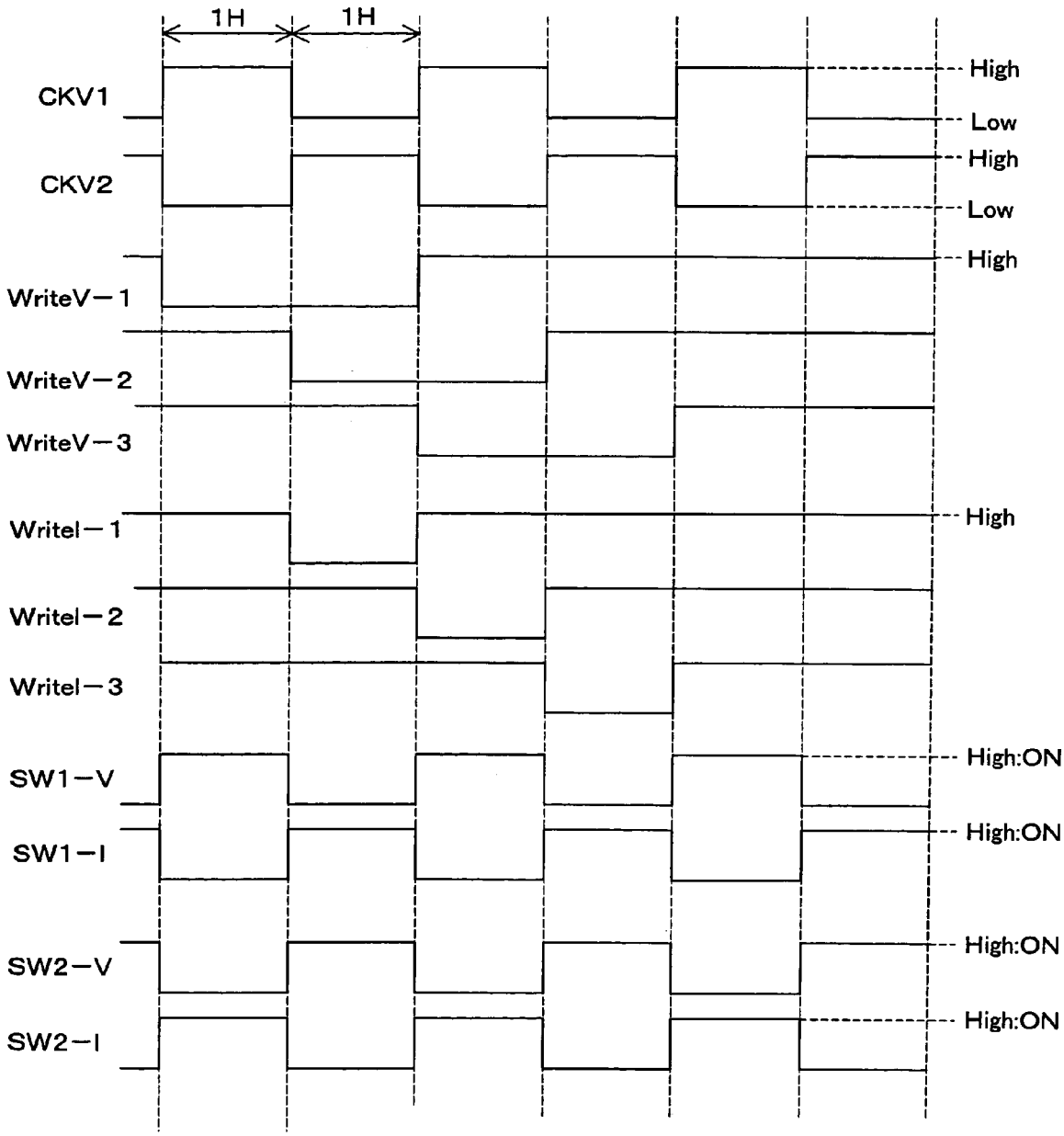
FIG. 4 is a timing chart of control clocks for explaining a circuit operation according to a preferred embodiment of the present invention.

In this manner, with a circuit of FIG. 6, signals shown in FIG. 4 are output and display operations of the pixels as described above are realized. In particular, with the circuit of the present embodiment, in display in each pixel, a voltage signal Vope is written into the storage capacitor C in a dot sequential manner and then, in the next 1H period, a gate voltage of the driver TFT 10 at a condition in which the current signal Ivideo is supplied through the driver TFT 10 is written into the storage capacitor C. Then, during the next 1H period, by the voltage written into the storage capacitor C, a current is supplied through the driver TFT 10 to the organic EL element 14 so that light is emitted. In this manner, because a voltage is written into the storage capacitor C in advance, the time required for writing data may be short and it is possible to write data corresponding to a large number of gradations into the storage capacitor C in a relatively short time. Because the actual data written into the storage capacitor C is written through a direct specification method in which the data is determined by supplying the current Ivideo through the driver TFT 10, it is possible to very precisely write data.

In the above description, a configuration is shown in which two data lines are used and data is written by a current for a period of 1H, but the number of data lines is not limited to two and a larger number of data lines maybe used. For example, it is possible to write data by a current for a period of 2H with three data lines.

What is claimed is:

1. An electroluminescence display circuit comprising:

a driver transistor for generating a drive current corresponding to a voltage supplied on its gate;

an electroluminescence element which is driven by a drive current from the driver transistor;

a drive current control transistor connected between the driver transistor and the electroluminescence element for controlling whether or not to supply the drive current from the driver transistor to the electroluminescence element;

a first write control transistor having a first region connected to a connection portion between the driver transistor and the drive current control transistor and a second region connected to a data line;

a second write control transistor having a first region connected to the data line and a second region connected to the gate of the driver transistor; and a storage capacitor connected to the gate of the driver transistor for storing the gate voltage, wherein a data voltage signal and a data current signal corresponding to data regarding an amount of light emission are sequentially supplied onto the data line;

the second write control transistor is switched on during when the drive current control transistor and the first write control transistor are switched off and a data voltage signal is supplied onto the data line, to write the data voltage signal into the storage capacitor;

the first write control transistor is switched on during when a data current signal is supplied onto the data line so that the data current signal is supplied to the data line through the driver transistor and the first write control transistor, and, at the same time, a voltage corresponding to the data current signal is wriff en into the storage capacitor via the second write control transistor; and the first and second write control transistors are switched off and the drive current control transistor is switched on so that a drive current corresponding to the voltage written into the storage capacitor is generated in the driver transistor and the drive current is supplied to the electroluminescence element via the drive current control transistor and light is emitted.

2. An electroluminescence display having an electroluminescence element in each of a plurality of pixels arranged in a matrix form for achieving a display by controlling light emission from each pixel, wherein each of a plurality of data lines is provided corresponding to each column of the matrix and a different data line among the plurality of data lines is connected to corresponding pixels for each row of the matrix; and display data is sequentially supplied from the plurality of data lines for pixels of each column of the matrix;

wherein two control lines are provided for each row of the matrix;

each of the pixels has a plurality of transistors controlled by the two control lines; and the writing of data voltage signal and the writing of the data current signal into each of the pixels are controlled by the two control lines.

3. An electroluminescence display according to claim 2, wherein both a data voltage signal and a data current signal regarding display data can be switched and supplied onto each of the plurality of data lines; and the data voltage signal and data current signal regarding display data are sequentially supplied to each pixel so that the display of each pixel is controlled.

* * * * *